US011111124B2

(12) United States Patent
Huber et al.

(10) Patent No.: US 11,111,124 B2
(45) Date of Patent: Sep. 7, 2021

(54) METHOD AND DEVICE FOR FILLING WITH A FILLING PRODUCT

(71) Applicant: KRONES AG, Neutraubling (DE)

(72) Inventors: Anton Huber, Neutraubling (DE); Josef Doblinger, Neutraubling (DE); Florian Angerer, Neutraubling (DE)

(73) Assignee: KRONES AG, Neutraubling (DE)

( * ) Notice: Subject to any disclaimer, the term of this patent is extended or adjusted under 35 U.S.C. 154(b) by 75 days.

(21) Appl. No.: 16/218,337

(22) Filed: Dec. 12, 2018

(65) Prior Publication Data

US 2019/0185309 A1 Jun. 20, 2019

(30) Foreign Application Priority Data

Dec. 14, 2017 (DE) ..... 10 2017 130 034.1

(51) Int. Cl.

| | |
|---|---|
| ***B67C 3/28*** | (2006.01) |
| ***B65B 3/34*** | (2006.01) |
| ***B65B 3/04*** | (2006.01) |
| ***B65B 3/26*** | (2006.01) |

(52) U.S. Cl.

CPC ..... *B67C 3/286* (2013.01); *B65B 3/04* (2013.01); *B65B 3/26* (2013.01); *B65B 3/34* (2013.01); *B67C 3/281* (2013.01)

(58) Field of Classification Search

CPC .... B65B 3/04; B65B 3/26; B65B 3/34; B67C 3/28; B67C 3/281; B67C 3/286

See application file for complete search history.

(56) References Cited

U.S. PATENT DOCUMENTS

| | | | | |
|---|---|---|---|---|
| 4,363,338 | A * | 12/1982 | Brown | B65B 3/045 141/114 |
| 10,259,697 | B2 * | 4/2019 | Clusserath | B67C 3/04 |
| 10,583,942 | B2 * | 3/2020 | Lindberg | B67C 3/24 |
| 10,625,884 | B2 * | 4/2020 | Lindberg | B65B 39/001 |
| 2007/0006939 | A1 * | 1/2007 | Clusserath | B67C 3/2628 141/40 |
| 2009/0166386 | A1 * | 7/2009 | Morand | B67C 3/281 222/559 |

(Continued)

FOREIGN PATENT DOCUMENTS

| | | | | |
|---|---|---|---|---|
| DE | 102015122032 | A1 * | 12/2015 | B67C 3/20 |
| DE | 102014117831 | | 6/2016 | |
| DE | 102015122032 | | 6/2017 | |

OTHER PUBLICATIONS

Translation of DE102014117831; all pages (Year: 2016).*
Search Report from German Patent Application No. DE 10 2017 130 034.1, dated Jul. 9, 2018 (7 pages).

*Primary Examiner* — Nicolas A Arnett
(74) *Attorney, Agent, or Firm* — Haynes and Boone, LLP

(57) ABSTRACT

A method for filling with a filling product, for example for filling with a beverage in a beverage filling plant by the free jet method, includes supplying a flow of filling product through a filling product supply line by opening a filling valve disposed in the filling product supply line and opening an associated regulating valve for regulating a volume flow, and closing the regulating valve and the filling valve in order to end the flow of filling product at the end of filling. The closing of the regulating valve and the filling valve are synchronized. A corresponding device is also described.

18 Claims, 5 Drawing Sheets

(56) References Cited

U.S. PATENT DOCUMENTS

| | | | | |
|---|---|---|---|---|
| 2011/0303322 | A1* | 12/2011 | Clusserath | B67C 3/286<br>141/8 |
| 2018/0362317 | A1* | 12/2018 | Clusserath | B67C 3/06 |
| 2019/0010039 | A1* | 1/2019 | Clusserath | B67C 3/12 |

* cited by examiner

METHOD AND DEVICE FOR FILLING WITH A FILLING PRODUCT

CROSS REFERENCE TO RELATED APPLICATION

This application claims priority from German Patent Application No. DE 10 2017 130 034.1, filed on Dec. 14, 2017 in the German Patent and Trademark Office, the disclosure of which is incorporated herein by reference in its entirety.

BACKGROUND

Technical Field

The present invention relates to a method and a device for filling with a filling product, for example for filling with a beverage in a beverage filling plant by the free jet method.

Related Art

Methods and devices are known for free-jet filling of beverages, in which a volume flow of the beverage is enabled and interrupted by the opening and closing of a filling valve. A container that is to be filled is disposed beneath, and spaced apart from, a filling product outlet of the filling valve, so that when the filling valve is open a free jet of the beverage can enter the container through a container aperture of the container. When the container is filled with the beverage, the filling valve is closed, and the flow of filling product is thereby interrupted. For this purpose, it is known to determine the quantity of filling product that has already been filled by means of a flow meter associated with the filling valve.

In order to achieve a filling outcome that is as accurate as possible, the filling valve is closed at high speed. As the filling valve is being closed, the cross-section available to the filling product in the filling valve is progressively reduced, usually by a first valve surface, preferably a valve cone, being displaced relative to a second valve surface, preferably a valve seat, towards the second valve surface. Due to the narrowing of the cross-section, the filling product in the filling valve undergoes an additional acceleration, which can lead to breakaway of the free jet, and this can cause spattering of the filling product, in particular lateral spattering. As a result there is a loss of filling product, and in addition filling product makes contact with the exterior of the container that is to be filled and/or parts of the plant.

The rapid closing of the filling valve can also lead to pressure surges in the filling element and/or in a line conveying the filling product to the filling valve. This is because filling product is also accelerated in the opposite direction to the actual direction of filling when the valve is being closed. It is necessary to compensate for these pressure surges, i.e. the energy thereof. In particular, if the line contains gas bubbles, these can have a spring effect due to their compressibility, with the result that oscillations arise in the line. These oscillations can be captured by the flow meter and interpreted as quantity that has flowed through. This can lead to errors in the determination of the quantity of filling product that has been filled.

It is further known to regulate the volume flow of the beverage to the filling valve by means of a regulating valve disposed upstream of the filling valve. In this manner, differing filling profiles can be used, which vary according to the filling product and the container that is to be filled.

In this case it is further known to issue control commands simultaneously to the filling valve and the regulating valve to interrupt the volume flow of the filling product. During the closing of the regulating valve, the volume flow that reaches the filling valve also decreases, so that less filling product flows through the filling valve during the closing of the filling valve, and thereby less filling product is additionally forcibly displaced or additionally accelerated when the filling valve is being closed. However, the regulating valve usually takes a different time to close from the filling valve. If the filling valve reaches its completely closed position before the regulating valve, the previously described pressure surge and spattering of the filling product can occur. If the regulating valve reaches its completely closed position before the filling valve, air can penetrate into the filling valve and breakaway of the flow can occur.

SUMMARY

An improved method for filling with a filling product, for example for filling with a beverage in a beverage filling plant by the free jet method, and a corresponding device are provided.

Accordingly, a method for filling with a filling product, generally for filling with a beverage in a beverage filling plant by the free jet method, is described, which includes the supplying of a flow of filling product through a filling product supply line by opening a filling valve disposed in the filling product supply line and opening an associated regulating valve for regulating a volume flow, and the closing of the regulating valve and the closing of the filling valve in order to end the flow of filling product at the end of filling. The closing of the regulating valve and the closing of the filling valve are synchronized.

In other words, the regulating valve and the filling valve are controlled such that the regulating valve and the filling valve reach the closed position substantially at the same time, or in a fixed temporal relationship with each other, and typically with only a slight time offset.

Due to the fact that the closing of the regulating valve and the closing of the filling valve are synchronized, a substantially ideal constriction of the jet of filling product emerging from the filling valve can be achieved. Because the filling valve is closing, a progressively decreasing outlet cross-section is available at the filling valve for the volume flow of filling product, which is decreasing due to the closing of the regulating valve, so that the velocity of flow through the filling valve can be substantially maintained. Due to the synchronized closing, the volume flow to the filling valve at the point in time at which the filling valve reaches the closed position is substantially shut off or only negligible. Thus it is possible substantially to prevent spattering that is due to acceleration of this filling product as it flows through the filling valve as it is closing. As a result, it is possible to close the filling valve at a high speed, while still reducing or entirely avoiding any pressure surges in the filling product, together with spattering and/or uncontrolled breakaway of the flow or jet of filling product. By means of the synchronized closing of the filling valve and the regulating valve, accurate and clean filling can consequently be achieved.

In several embodiments, the regulating valve and the filling valve are controlled with a time delay equal to a time offset. By this means it can be ensured that the regulating valve and the filling valve reach the closed position synchronously, even if they have differing closing speeds. Consequently, a particularly accurate and stable filling can be achieved by this means.

In various embodiments, the closing of the regulating valve is initiated by a first control command and the closing of the filling valve is initiated by a second control command, wherein the second control command is initiated with a time delay from the first control command equal to the time offset. By this means a particularly precisely synchronized closing is possible. The second control command can be initiated following the first control command by the time offset, or preceding the first control command by the time offset, depending on whether the regulating valve has a longer closing time or a shorter closing time than the filling valve. Generally, the second control command is initiated following the first control command by the time offset.

In order to enable the synchronized closing of the regulating valve and the filling valve to be particularly precise, without the need to intervene in the other parameters of the control system, in certain embodiments the individual time offset is determined, wherein typically the time offset is determined from the difference between a closing time of the regulating valve and a closing time of the filling valve.

By this means it is possible to take into account for the time offset each of the pairs including regulating valve and filling valve that are installed in a device and/or plant. Consequently, the time offset can be provided in a particularly accurate manner. In particular when a plurality of regulating valve and filling valve pairs are provided in the device and/or plant, and due to the design of the device and/or plant the individual pairs have differing actuation times and lag times, an appropriate time offset can be provided accurately in a simple manner for each pair or each combination.

A particularly simple and accurate determination of the time offset, in particular taking into account the other components that are present in the device and/or plant that includes the filling valve and the regulating valve, can be achieved, according to some embodiments, in that the time offset is determined based on a flow measurement of the filling product in the filling product supply line, wherein the closing time of the filling valve is determined using the flow measurement.

According to certain embodiments, the closing time of the filling valve is determined on the basis of a change over time in the flow, i.e. a first derivative of the flow over time. By this means the closing time can be particularly accurately determined.

According to some embodiments, the closing time of the filling valve is determined with respect to a minimum, generally a first minimum, in the change over time in the flow subsequent to the initiation of the second control command, wherein the closing time of the filling valve is defined as a length of time between the initiation of the second control command and the time point at which the minimum occurs. Due to the rapid decrease in the flow when the filling valve is closed, a clear minimum occurs in the course of the change over time of the flow, and it is technically possible to determine this minimum simply and accurately by measurement. Furthermore, the time difference between the occurrence of the minimum and the time point at which the filling valve reaches the closed position is negligible. Thus by this means it is possible in a simple manner, without intervention in the remaining process parameters of the control or regulation of the device and/or plant, to achieve a virtually ideal synchronization of the closing of the filling valve and the closing of the regulating valve. This measurement is typically carried out while the regulating valve is maintained in an unchanging state, and generally while the regulating valve is fully open.

If, according to some embodiments, when a plurality of pairs of regulating valve and filling valve are provided, the applicable time offset is individually determined for each individual regulating valve and filling valve pair in the plurality of pairs of regulating valve and filling valve that are provided, synchronized closing of each of the plurality of regulating valve and filling valve pairs can be provided in a simple manner.

To regulate the volume flow, the regulating valve generally switches between at least two different volume flows, for example between a higher and a lower volume flow, or between a volume flow and no volume flow. In other words, the regulating valve can also be designed as a simple switching valve.

Usually, in order to regulate the volume flow, the regulating valve switches between more than two different volume flows.

Generally, the regulating valve switches the volume flow steplessly, wherein the regulating valve typically adjusts the volume flow proportionally, and can be designed as a proportional valve.

A device for filling with a filling product, for example for filling with a beverage in a beverage filling plant by the free jet method, is also described.

Accordingly, a device for filling with a filling product, for example for filling with a beverage in a beverage filling plant by the free jet method, is provided, which includes a filling valve disposed at the end of a filling product supply line for opening and closing the filling product supply line, and a regulating valve upstream of the filling valve for regulating a volume flow of the filling product to the filling valve. A control system is provided, which is configured to close the regulating valve and the filling valve in a synchronized manner.

By means of this device, the advantages and effects described above in reference to the method are analogously achieved.

Generally, a flow meter is further provided for measuring the flow rate and/or volume flow of the filling product to the filling valve and/or to the regulating valve.

In the device, and in the method described above, the regulating valve is typically a proportional valve, which can be positioned in a controlled manner via a suitable control system. In other words, the control system can specify a particular lift position of the proportional valve, which then moves to this lift position in a defined and reliable manner. A proportional valve can for example have a stepper motor as actuator, in order to enable precise and reproducible controlled displacement to a desired lift position.

The regulating valve can also be a switching valve, by means of which switching is possible between at least two differing volume flows. For example, the regulating valve can switch between an open position with a first volume flow and a closed position, in which no volume flow flows through the regulating valve. Generally, the regulating valve can switch between a plurality of different volume flows in order to achieve a regulation of the volume flow.

In the device, and in the method described above, the filling valve is typically embodied in the form of a simple switching valve, which can be designed for example as a seat valve. The filling valve is displaced by means of a suitable actuator, for example a pneumatic actuator, from a fully closed position to a fully open position, and vice versa. Intermediate positions are not possible.

In addition, at the end of the filling product supply line, i.e. the filling valve, a filling product outlet is generally provided for discharging filling product, for example as a free jet.

According to various embodiments, the control system is configured to actuate the regulating valve and the filling valve with a time delay equal to a time offset.

According to some embodiments, the control system is configured to issue a first control command to close the regulating valve and, with a time delay from the first control command equal to the time offset, to issue a second control command to close the filling valve.

According to several embodiments, the control system is configured to determine the time offset, wherein generally the time offset is determined from the difference between a closing time of the regulating valve and a closing time of the filling valve.

According to certain embodiments, a flow meter is associated with the filling valve and the regulating valve, wherein the control system is configured to determine the time offset based on a flow measurement of the flow of the filling product through the filling product supply line, wherein the closing time of the filling valve is determined using the flow measurement.

According to various embodiments, the control system is configured to determine the closing time of the filling valve on the basis of a change over time in the flow.

According to certain embodiments, the control system is configured to determine the closing time of the filling valve with respect to a minimum, generally a first minimum, in the change over time in the flow, as measured by a flow meter, subsequent to the initiation of the second control command, wherein the closing time of the filling valve is defined as a length of time between the initiation of the second control command and the point in time at which the minimum occurs. This measurement of the flow and determination of the closing time of the filling valve are generally carried out while the regulating valve is not in motion, and typically while the regulating valve is fully open.

According to some embodiments, a plurality of pairs including a filling valve and its associated regulating valve are provided, wherein generally the applicable time offset is individually determined for each individual regulating valve and filling valve pair.

BRIEF DESCRIPTION OF THE FIGURES

Further embodiments and aspects of the present invention are more fully explained by the description below of the figures.

DETAILED DESCRIPTION

Examples of embodiments are described below with the aid of the figures. In the figures, elements which are identical or similar, or have identical effects, are designated with identical reference signs, and repeated description of these elements is in part dispensed with in order to avoid redundancy.

Figure 1:
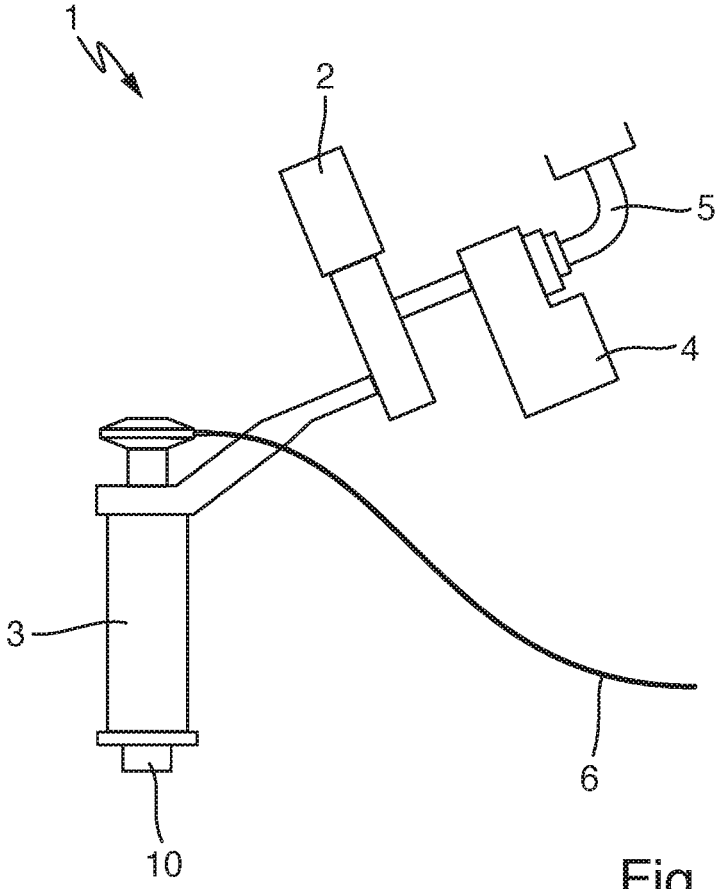
FIG. 1 is a schematic side view of a device for filling with a filling product.

FIG. 1 shows a schematic side view of a device 1 for filling with a filling product. The device 1 shown here can be used in particular for filling with a beverage in a beverage filling plant by the free jet method. The device 1 has a filling valve 3, disposed at the end of a filling product supply line 5, for opening and closing the filling product supply line 5, and a regulating valve 2 upstream of the filling valve 3 for regulating a volume flow of the filling product to the filling valve 3. In addition, a flow meter 4 is provided on the filling product supply line 5 for determining a flow rate or volume flow of filling product through the filling product supply line 5.

In the example embodiment that is shown, the filling valve 3 is in the form of a pneumatically operated filling valve 3. To drive the pneumatically operated filling valve 3, tubing 6 is provided, by means of which pneumatic air can be supplied to the filling valve 3, in order to achieve a switching of the filling valve 3.

The flow meter 4 is disposed upstream of the regulating valve 2. In other words, the regulating valve 2 is disposed between the flow meter 4 and the filling valve 3.

At the end of the filling product supply line 5, i.e. the filling valve 3, a filling product outlet 10 is provided, from which a free jet of the filling product that is to be filled can discharge.

The filling valve 3 and its associated regulating valve 2 together form a pair 7 including filling valve 3 and regulating valve 2. Each pair 7 can have its own flow meter 4 associated with it.

In the example embodiment that is shown, the regulating valve 2 is designed such that it can switch steplessly. The regulating valve 2 is here designed as a proportional valve.

In an alternative embodiment, the regulating valve 2 for regulating the volume flow can only switch between at least two different volume flows. For example, the regulating valve 2 can switch between a higher and a lower volume flow, or between a volume flow and no volume flow. In other words, the regulating valve 2 can also be designed as a simple switching valve.

Generally, however, the regulating valve 2 for regulating the volume flow switches between more than two different volume flows.

Figure 2:
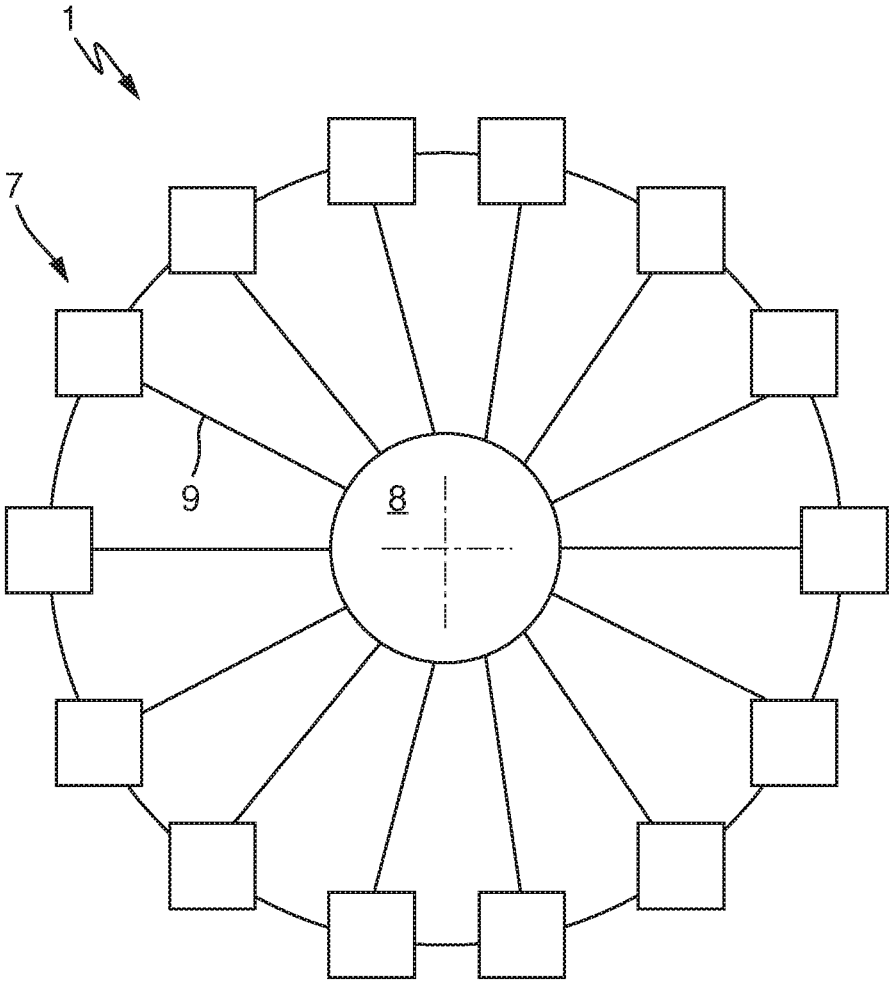
FIG. 2 is a schematic plan view of the device from FIG. 1.

FIG. 2 shows a schematic overall plan view of a filler carousel of the device 1 from FIG. 1. On the periphery of the filler carousel are disposed a plurality of filling valve 3 and regulating valve 2 pairs 7, such as shown in FIG. 1, in order in this manner to produce a continual stream of filled containers.

The device 1 further has a control system 8, which is in communication via connecting elements 9 with each individual filling valve 3 and regulating valve 2 pair 7. The control system 8 is configured to close the regulating valve 2 and the filling valve 3 of each pair 7, in each case in a synchronized manner.

In the following part of this description, a method for filling with a filling product is described with reference to the device according to FIGS. 1 and 2. The method described here can be used in particular for filling with a beverage in a beverage filling plant by the free jet method. The method is here illustrated by means of FIGS. 3 to 5.

Figure 3:
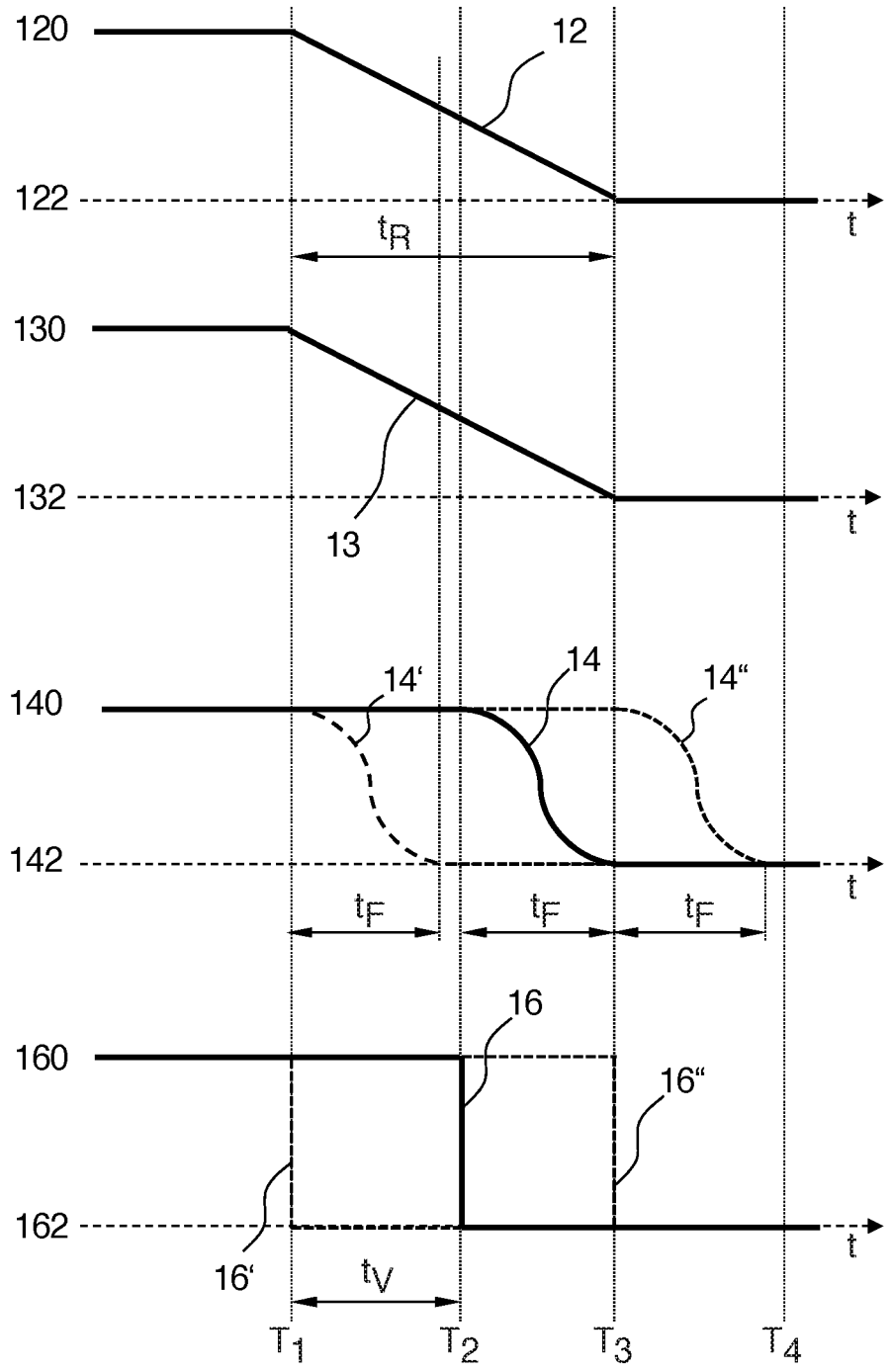
FIG. 3 is a schematic switching diagram of a portion of a method for controlling the device from FIGS. 1 and 2.

FIG. 3 is a schematically shown switching diagram of a portion of the method for controlling the device 1 from FIGS. 1 and 2. FIG. 3 shows a regulating valve lift curve 12, a first control signal 13 for setting the lift 12 of the regulating valve 2, a valve cone lift curve 14 of a valve cone of the filling valve 3, and a second control signal 16 for setting the switching of the valve cone of the filling valve 3, over time.

The filling valve 3 is generally embodied in the form of a simple switching valve, which can be designed for example as a seat valve. The filling valve 3 is displaced by means of a suitable actuator, for example a pneumatic actuator, from a fully closed position to a fully open position, and vice versa. Intermediate positions are, however, not possible.

The regulating valve 2 is typically a proportional valve, which can be positioned in a controlled manner by means of a suitable control system. In other words, the control system can specify a particular lift position of the proportional valve, which then adopts this lift position in a defined and reliable manner. A proportional valve can for example have a stepper motor as actuator, in order to enable precise and reproducible controlled adoption of a desired lift position.

Reference sign 120 indicates an open position of the regulating valve 2. In the open position 120 of the regulating valve 2, a maximum possible volume flow of the filling product that is to be filled can flow in the direction of the filling valve 3. In the closed position, which is indicated by the reference sign 122, the volume flow to the filling valve 3 is shut off. Reference sign 130 indicates an "open" signal setting specified by the control system 8, by means of which a specified lift of the regulating valve 2 can be regulated or set, and the reference sign 132 indicates a "closed" signal setting of the first control signal 13.

Thus in the regulating valve 2, the controlled adoption of intermediate positions between the open position 120 and the closed position 122 is also possible. The position of the regulating valve between the open position 120 and the closed position 122 accordingly follows the ramp function of the first control signal 13. The indicated ramp function of the position and the ramp function of the control signal 13 are synchronous.

As can be seen from FIG. 3, the control signal 13 is initiated by the control system 8 at a point in time T1, and effects a closing of the regulating valve 2. Due to this the regulating valve 2 progressively moves along the ramp function from the open position 120 to the closed position 122, which it reaches at time point T3. The regulating valve 2 thus has a closing time of tR, which corresponds to the length of time between time point T1 and time point T3. This closing time depends on the control system, and cannot be accelerated without limit due to the design of the regulating valve 2. In other words, the closing time is known to the control system.

An open position of the filling valve 3 is also shown, indicated by reference sign 140. In the open position 140, the valve cone of the filling valve 3 is in a lifted position, so that the flow cross-section in the filling valve 3 is at a maximum. In the closed position indicated by the reference sign 142, the volume flow is shut off by the filling valve 3. Reference sign 160 indicates an "open" signal setting specified by the control system 8, and reference sign 162 indicates a "closed" signal setting of the second control signal 16. The filling valve 3 can adopt only the open or the closed position; intermediate positions are not possible due to the structure of the filling valve 3.

If, as indicated by reference sign 16', the second control signal is initiated simultaneously with the first control signal 13, the valve cone of the filling valve 3 traverses the curve indicated by the reference sign 14' to reach the closed position 142. To reach the closed position 142 from the open position 140, the filling valve requires the closing time tF. Because the closing time tF of the filling valve 3 is shorter than the closing time tR of the regulating valve 2, the filling valve 3 reaches the closed position 142 while the regulating valve 2 is not yet closed. Due to this, pressure surges in the filling product supply line 5, induced by the closing of the filling valve 3, can occur, leading to oscillations of the filling product in the filling product supply line 5, which can be incorrectly interpreted by the flow meter 4 as additional flow.

These pressure surges can be prevented if, as indicated by the reference sign 16", the second control signal is initiated at the time point T3, after the regulating valve 2 has reached the closed position 122. Accordingly, only then does the filling valve 3 begin to move to the closed position 142, as indicated by the reference sign 14". As a result, however, because at this time the filling valve 3 is open and the regulating valve 2 is closed and can provide no counter pressure of filling product, air from the surroundings can enter the filling product supply line 5.

In order to remedy this behavior, the regulating valve 2 and the filling valve 3 are closed simultaneously. Accordingly, in the present example embodiment the filling valve 3 and the regulating valve 2 reach their closed positions, 122 and 142 respectively, at substantially the same time point T3. To achieve this, the valve cone of the filling valve 3 must traverse the curve that is indicated by means of the reference sign 14. The control signal 16 is consequently initiated at the time point indicated here by the reference sign T2, which is in advance of the time point T3 by a period equal to the closing time tF. In other words, the regulating valve 2 and the filling valve 3 are controlled to operate with a time offset tV, wherein the closing of the regulating valve 2 is initiated by the first control command 13 at time point T1, and the closing of the filling valve 3 is initiated by the second control command 16 at time point T2, and wherein the second control command 16 is initiated after a time delay equal to the time offset tV relative to the first control command 13.

In the present case, the filling valve 3 is switched by a control system between the open position 140 and the closed position 142. The speed, and consequently the closing time tF, is therefore not controlled by the control system. In addition, the closing times of the individual pairs 7 of the device 1 differ.

In order to be able to provide synchronized closing in accordance with reference signs 12 and 14 of each pair 7, the time offset tV is determined for each pair. In the present case, the time offset tV is determined from the difference between the closing time tR of the regulating valve 2 and the closing time tF of the filling valve 3. To achieve this, the closing time tF of the filling valve 3 is determined using the flow measurement.

For this purpose, the control system 8 determines a change over time in the flow through the filling product supply line 5 as measured by the flow meter 4. To do this, the flow is determined during a closing process of the filling valve 3 that takes place prior to the actual filling with the filling product in normal operation, in which containers that are to be filled are filled with filling product.

Figure 4:
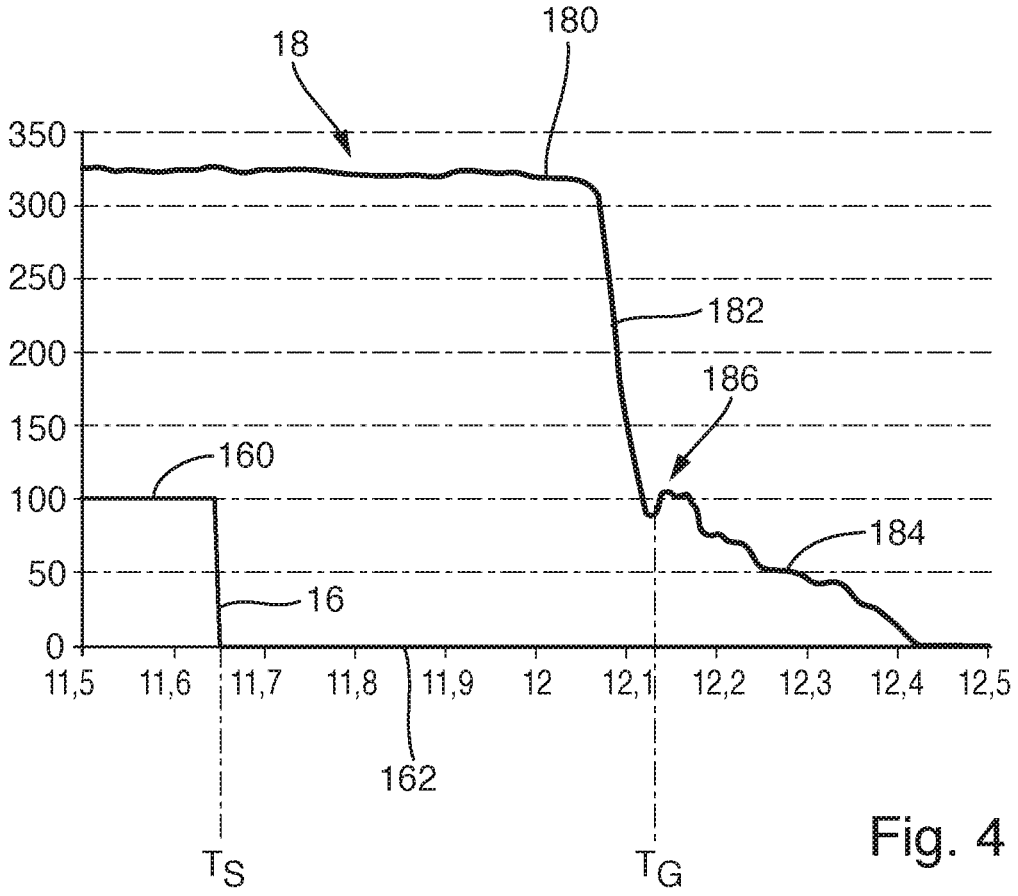
FIG. 4 is a schematic graphical representation of a flow over time.

FIG. 4 shows schematically and by way of example a graphical representation of the measured flow 18 in ml/s of the filling product, against time in seconds, for one of the filling valves 3 of the device 1, as determined by the control system 8. Over the entire measuring period shown, the regulating valve 2 is maintained in a predetermined open switching position.

Reference sign 16 again indicates the second control signal, which controls the filling valve 3. In the initial portion of the measuring period that is shown, the filling valve 3 is maintained in the open position, as indicated with reference sign 160. The flow 18 corresponds here to the flow in a filling phase 180. At the time point TS, the second control command 16 for switching the filling valve 3 to the closed position 162 is issued. As is immediately evident in FIG. 4, the reaction, in the sense of a change in the flow 18, is time-delayed, by approximately 0.4 seconds in this exemplary embodiment. This is referred to as the closing phase, indicated here by the reference sign 182. This time lag is due to the intrinsic inertia of the actuator of the filling valve 3 and of the media that are used for filling.

Following the closing phase 182, a decreasing, oscillating volume flow takes place, which is substantially produced due to the oscillations in the filling product created by the closing of the filling valve 3, and is interpreted by the flow meter 4 as flow 18. Thus the transition 186 from the closing phase 182 to the oscillation phase 184 represents the time point TG at which the closed position is reached.

Figure 5:
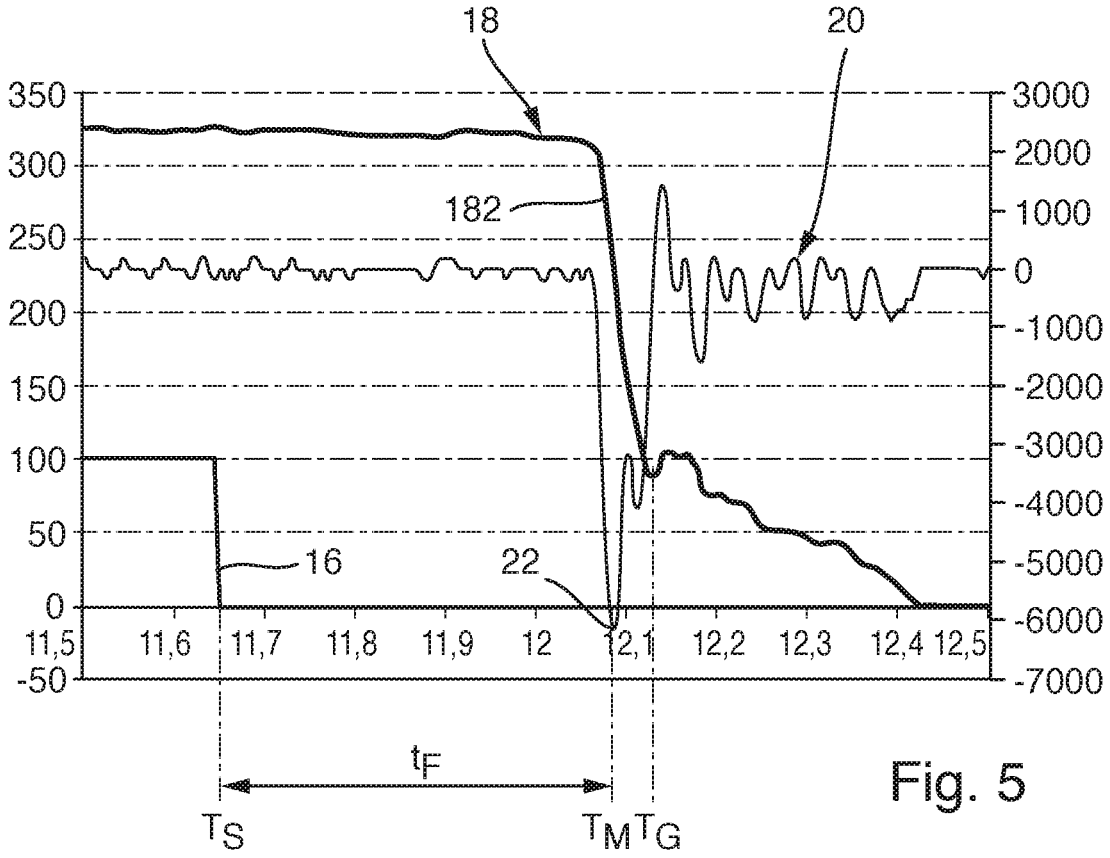
FIG. 5 is a schematic graphical representation of the flow from FIG. 4 and its derivative over time.

FIG. 5 shows schematically the graphical representation of the flow 18 from FIG. 4 and its derivative 20 over time (as calculated in the control system 8). As is immediately evident from FIG. 5, just before the closing time point TG is reached, a clear, characteristic minimum 22 of the derivative 20 arises. This clear minimum 22 of the derivative 20 is recorded by the control system 8 and designated by the control system 8 as time point TM, the point in time at which the minimum 22 occurs.

The closing time tF of the filling valve 3, which the filling valve 3 requires after the initiation of the control command 16 in order to reach the closed position, is now determined with respect to this minimum 22 of the time derivative 20 of the flow 18 after the initiation of the second control command 16. The closing time tF is thereby defined as the length of time from the initiation of the second control command 16, at the time point TS, to the time point TM at which the first minimum 22 of the derivative of the flow 18 occurs.

Consequently, the determined and defined closing time tF is an approximation to the actual closing time, which is equal to the interval between the time points TS and TG.

The time offset tV, by which the initiation of the second control command 16 is delayed with respect to the first control command 13, is determined by the control system 8 from the difference between the closing time tR of the regulating valve 2, and the closing time tF of the filling valve 3 as determined and defined by the control system 8, i.e. as tV=tR−tF.

In order to determine the closing time tF of every filling valve 3 in the device 1, i.e. the time offset tV of every filling valve 3 and regulating valve 2 pair 7 in the device 1, the above-mentioned method is carried out for each individual filling valve 3 and regulating valve 2 pair 7 of the plurality of pairs 7 that are provided. In order to reduce the time required for this as far as possible, the determination by the control system 8 can be carried out at least in part in parallel. This determination can also be made for each filling product, with its individual viscosity and temperature.

To the extent applicable, all features described in the individual example embodiments can be combined with each other and/or exchanged, without departing from the field of the invention.

What is claimed is:

1. A method for filling with a filling product, comprising:

supplying a flow of the filling product through a filling product supply line by opening a filling valve disposed in the filling product supply line and opening a regulating valve configured to regulate a volume flow of the filling product;

closing the regulating valve and the filling valve to end the flow of filling product at an end of filling, wherein the closing of the regulating valve and the filling valve are synchronized such that the regulating valve and the filling valve reach a closed position at the same time; and controlling the regulating valve and the filling valve with a time delay equal to a time offset.

2. The method of claim 1, further comprising providing a plurality of pairs of the regulating valve and the filling valve, and determining the time offset for each pair of the plurality of pairs.

3. The method of claim 1, wherein the closing of the regulating valve is initiated by a first control command and the closing of the filling valve is initiated by a second control command, and the second control command is initiated with a time delay from the first control command equal to the time offset.

4. The method of claim 3, further comprising determining the time offset from a difference between a closing time of the regulating valve and a closing time of the filling valve.

5. The method of claim 4, further comprising determining the time offset based on a flow measurement in the filling product supply line and determining the closing time of the filling valve using the flow measurement.

6. The method of claim 5, wherein the flow measurement comprises a change over time in a flow in the filling product supply line.

7. The method of claim 6, wherein the closing time of the filling valve is determined with respect to a minimum in the change over time in the flow and subsequent to an initiation of the second control command.

8. The method of claim 7, wherein the closing time of the filling valve is defined as a length of time between the initiation of the second control command and a time point at which the minimum occurs.

9. The method of claim 1, further comprising switching the regulating valve between at least two different volume flows for regulating the volume flow.

10. The method of claim 9, wherein the switching is stepless and adjusts the volume flow proportionally.

11. A device for filling with a filling product, comprising:

a filling valve disposed at an end of a filling product supply line and configured to open and close the filling product supply line;

a regulating valve disposed upstream of the filling valve and configured to regulate a volume flow of the filling product to the filling valve; and a control system configured:

to close the regulating valve and the filling valve in a synchronized manner such that the regulating valve and the filling valve reach a closed position at the same time, and to actuate the regulating valve and the filling valve with a time delay equal to a time offset.

12. The device of claim 11, wherein the control system is further configured to issue a first control command to close the regulating valve and, with a time delay from the first control command equal to the time offset, to issue a second control command to close the filling valve.

13. The device of claim 12, wherein the control system is further configured to determine the time offset, and the time offset is determined from a difference between a closing time of the regulating valve and a closing time of the filling valve.

14. The device of claim 13, further comprising a flow meter associated with the filling valve and the regulating valve, wherein the control system is further configured to determine the time offset based on a flow measurement, and the closing time of the filling valve is determined using the flow measurement.

15. The device of claim 14, wherein the flow measurement comprises a change over time in a flow in the filling product supply line.

16. The device of claim 15, wherein the control system is further configured to determine the closing time of the filling valve with respect to a minimum in the change over time in the flow subsequent to initiation of the second control command, and the closing time of the filling valve is defined as a length of time between the initiation of the second control command and a point in time at which the minimum occurs.

17. The device of claim 11, wherein the regulating valve is configured to switch between at least two different volume flows for regulating the volume flow.

18. The device of claim 11, wherein the regulating valve comprises a proportional valve.

* * * * *